United States Patent [19]

MacPhail

[11] Patent Number: 4,534,122

[45] Date of Patent: Aug. 13, 1985

[54] FIT AND SUPPORT SYSTEM FOR SPORTS FOOTWEAR

[75] Inventor: David M. MacPhail, Whistler Mountain, Canada

[73] Assignee: Macpod Enterprises Ltd., Squamish, Canada

[21] Appl. No.: 556,939

[22] Filed: Dec. 1, 1983

[30] Foreign Application Priority Data

Dec. 1, 1982 [CA] Canada ..... 416815

[51] Int. Cl.[3] ..... A43B 7/14

[52] U.S. Cl. ..... 36/88; 36/119; 36/54

[58] Field of Search ..... 36/88, 99, 109, 117, 36/118, 119, 120, 54

[56] References Cited

U.S. PATENT DOCUMENTS

| | | | |
|---|---|---|---|
| 3,169,325 | 2/1965 | Fesl | 36/117 |
| 3,313,046 | 4/1967 | Werner et al. | 36/2.5 |
| 3,372,495 | 3/1968 | Finn | 36/2.5 |
| 3,374,561 | 3/1968 | Werner et al. | 36/2.5 |
| 3,599,351 | 8/1971 | Check | 36/2.5 |
| 3,657,827 | 4/1972 | Rieker | 36/50 |
| 4,253,251 | 3/1981 | Salomon | 36/119 |
| 4,391,049 | 7/1983 | Parisotto | 36/54 X |
| 4,406,073 | 9/1983 | Spademan | 36/54 X |

FOREIGN PATENT DOCUMENTS

| | | | |
|---|---|---|---|
| 248917 | 8/1966 | Austria | 36/117 |
| 764657 | 9/1967 | Canada | 36/2.5 |
| 806885 | 2/1969 | Canada | 36/2.5 |
| 807888 | 3/1969 | Canada | 36/2.5 |
| 811930 | 5/1969 | Canada | 36/2.5 |
| 48965 | 4/1982 | European Pat. Off. | 36/88 |
| 2230155 | 12/1974 | France | 36/118 |
| WO79/00886 | 11/1979 | PCT Int'l Appl. | 36/88 |

*Primary Examiner*—Werner H. Schroeder
*Assistant Examiner*—T. G. Graveline

[57] ABSTRACT

A fit and support system for sports footwear, particularly for ski boots, comprises up to three separate supports. A lower support is shaped and dimensioned to bear evenly against the dorsal or upper surface of the foot, including the medial and lateral aspects thereof, forwardly of the ankle joint to permit unrestricted dorsiflexion of the foot at the ankle joint within the normal range. The support is sufficiently firm to transmit pressure from the footwear to the wearer's foot to reduce articulation of the bones of the mid-foot during use. An upper support may also be present. This is shaped and dimensioned to bear evenly against the front of the lower leg above the angle joint. A complementary support may also bear against the lower leg at the rear and sides above the ankle joint. The support system allows proper flexion of the ankle joint while providing firm support for the bones of the mid-foot. When used in ski boots, the system gives the skier good balance and control of the boot even during fast downhill skiing.

26 Claims, 15 Drawing Figures

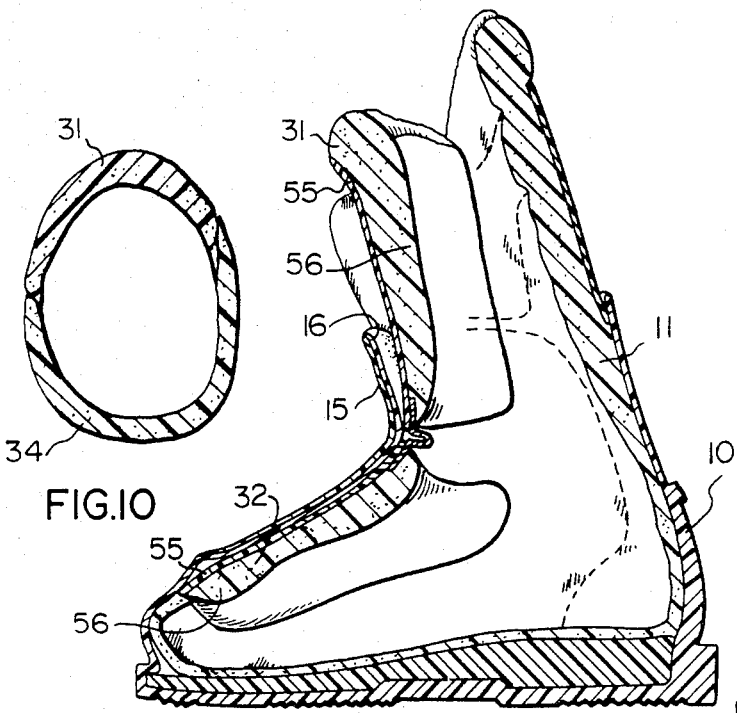
FIG.10
FIG. 9
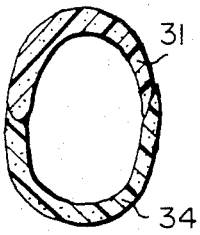
FIG. 11
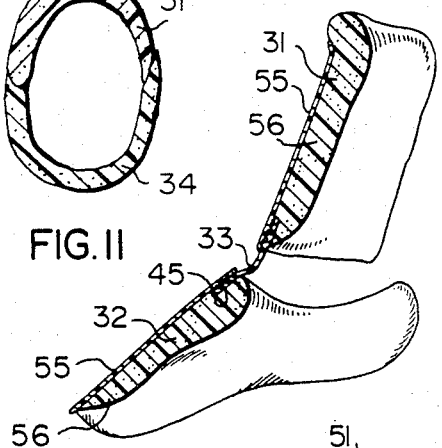
FIG.12
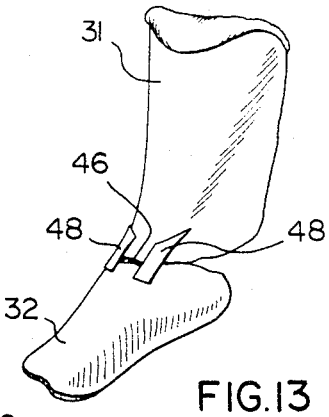
FIG.13
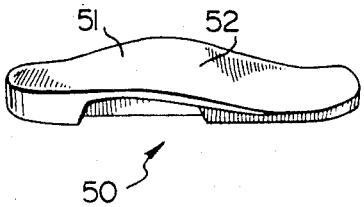
FIG.14

FIT AND SUPPORT SYSTEM FOR SPORTS FOOTWEAR

BACKGROUND OF THE INVENTION

1. Field of the Invention

This invention relates to a fit and support system for sports footwear, particularly ski boots, and to footwear utilizing such a system.

2. Description of the Prior Art

Designers of ski boots intended for downhill (alpine) skiing have recognized the need to provide support for the leg, ankle and foot, but have tended to produce boots that are uncomfortable, that do not give the skier proper control, and that restrict those movements of the ankle joint that are necessary during skiing.

Fore and aft movements of the leg at the ankle joint (i.e. plantarflexion and dorsiflexion of the foot) are often restricted or prevented in prior art ski boot by the boot tongue or other structure designed to restrain movements of the foot. Typically, a boot tongue extends from near the toes to the lower shin and, in order to provide good padding and support, is relatively inflexible. Such a tongue presents considerable resistance to dorsiflexion of the foot.

Some boots are designed to permit ankle flexion by pivotally attaching an ankle cuff part to a lower boot part fitting around the foot, without requiring a full length tongue. Such boots, however, as well as being complex and expensive to manufacture, still tend to restrict ankle flexion to some extent and do not provide proper support. Another problem with the known boots is that padding intended to hold the foot firmly tends to produce discomfort without effectively immobilizing the foot, and padding above the ankle often results in uncomfortable chaffing or pinching as well as poor ski control when the ankle is flexed.

Rather than concentrating on providing a new boot design, the inventor has studied ways of overcoming the above problems by providing a fit and support system which can find application in many ski boots of current design, as well as in other types of sports footwear.

It is therefore an object of the invention to provide a sports footwear fit and support system that gives proper support but at the same time allows substantially unrestricted plantarflexion and dorsiflexion of the foot at the ankle joint.

According to one aspect of the invention, there is provided a fit and support system for sports footwear, comprising a lower support shaped and dimensioned to bear evenly against the dorsal surface of the foot, including the medial and lateral aspects thereof, forwardly of the ankle joint, and an upper support shaped and dimensioned to bear evenly against the lower leg at the front above the ankle joint, said supports being capable of independent relative motion to permit unrestricted dorsiflexion of the foot at the ankle joint within the normal range, and said lower support being sufficiently firm to transmit pressure from the footwear to the wearer's foot to substantially reduce articulation of the bones of the mid-foot during use.

According to another aspect of the invention, there is provided a support for sports footwear comprising a body of material shaped and dimensioned to fit within the footwear and to bear evenly against the dorsal surface of the foot, including the medial and lateral aspects thereof, forwardly of the ankle joint, the material being sufficiently firm to transmit pressure from the footwear to the wearer's foot to substantially reduce articulation of the bones of the mid-foot during use without restricting dorsiflexion of the foot at the ankle joint within the normal range.

According to yet another aspect of the invention there is provided a boot assembly for a foot, comprising an outer boot of stiff material having a fastener therefor, and a fit and support system for the boot, said system comprising a lower support shaped and dimensioned to bear against the dorsal surface of the foot, including the lateral and medial aspects thereof, and an upper support shaped and dimensioned to bear against the lower shin at the front above the ankle, said supports being capable of independent relative motion to permit unrestricted dorsiflexion of the foot at the ankle joint within the normal range, and said lower support being sufficiently rigid to transmit force from the boot to the wearer's foot to substantially reduce articulation of the bones of the mid-foot during use.

According to yet another aspect of the invention there is provided sports footwear including a support for the foot, said support comprising a body of material shaped and dimensioned to fit within the footwear and to bear evenly against the dorsal surface of the foot, including the medial and lateral aspects thereof, forwardly of the ankle joint so as not to restrict dorsiflexion of the foot at the ankle joint within the normal range, said material being sufficiently firm to transmit pressure from the footwear to the wearer's foot to substantially reduce articulation of the bones of the mid-foot during use.

The lower support preferably only contacts those parts of the foot necessary to achieve the desired immobilization of the bones of the mid-foot. For example, the support preferably does not contact the toes or the sides of the foot where they curve under to join the sole.

The boot assembly preferably also contains an inner boot of soft material.

The support system of the invention is especially adapted for use with footwear having a substantially rigid foot bed (i.e., combined sole and heel).

The system of the invention applies significant pressure to the dorsal (upper) surface of the foot over the instep, including the lateral and medial aspects thereof, and hence to the bones of the mid-foot, to substantially prevent these bones from moving relative to each other. The term 'lateral' is intended to mean the part of the foot on the outside of the mid-sagittal plane of the foot (i.e. the right side of the right foot and the left side of the left foot), and the term 'medial' is intended to mean the part of the foot on the inside of the mid-sagittal plane of the foot). The lateral and medial aspects of the dorsal surface of the foot are thus the parts of the upper surface extending on each side of the instep approximately to the position where the upper surface starts to curve under to form the sole of the foot. The pressure in this area tends to make the numerous bones act more like a single bone, or at least reinforces the ligaments and muscles, and also forces these bones against the heel bone to prevent the heel from lifting relative to the bottom of the boot. The pressure applied to the metatarsal bones also maintains these bones in intimate contact with the bottom of the boot.

The lower support preferably loads (i.e. transmits force to) the tarsal bones forward of the ankle joint and the metatarsal bones, from the dorsal or upper surface of the foot, and also sweeps down on each side of the foot to enclose these mid-foot bones and also the forward part of the heel bone, in order to additionally apply lateral and medial loading of these bones.

By shaping the lower part of the tongue to contact the upper surface of the foot evenly and by ensuring that the tongue occupies all of the free space in the boot (when closed) above the foot, evenly applied pressure against the mid-foot bones at right angles to the boot surface can be achieved, rather than generally horizontal pressure on each side of the foot or a generalized crush that many boots provide. The system of the invention thus applies firm pressure to specific areas of the foot and (if necessary) the leg rather than generalized pressure to all parts thereof. Unsupported parts are thus left free for normal movement.

The heel and mid-foot bones form the supportive base for the foot and, by stabilizing these bones relative to each other, the ankle joint becomes almost as stable and strong as the knee or hip joint. By greatly reducing medial and lateral movement of the foot below the ankle joint in this way, ankle wobble is reduced or eliminated and consequently there is no longer any need to support the ankle itself, and thus restrict its movement, by applying lateral and medial pressure against the malleolus (the projection at each side of the ankle joint). Previously, lateral and medial pressure on the ankle bones was considered desirable or essential, but can now be eliminated because ankle joint pronation and supination (lateral and medial bending, such as when the ankle wobbles) is permitted in the main by articulations of the bones below the ankle joint itself, and such articulations are substantially reduced in the present invention.

Despite providing proper support for the foot, the fit and support system allows uninhibited dorsiflexion of the ankle joint within the normal range of motion. In particular, neither the upper support nor the lower support extends into the 'crease' of the ankle joint, i.e. the junction between the upper surface of the foot and the front surface of the leg. This leaves the junction clear so that proper flexion of the ankle joint can take place. The upper support is capable of independent relative motion with respect to the lower support and is preferably, but not necessarily, attached to the lower support by a flexible connection. Thus dorsiflexion can take place without interference with the loading applied by the lower support. This is a very important feature of the present invention, at least in its preferred forms, because proper fore and aft balance is a most important feature of ski boot design and when this has been achieved in the past it has usually been done at the expense of ankle freedom.

Although the fit and support system does not restrict ankle flexion, the ski boot itself may do so to some extent. However, this is not usually disadvantageous, provided the ankle can move through the normal range required for skiing and provided the boot applies force evenly and predictably to the skier's leg as the ankle is flexed.

The supports, particularly the lower support, should preferably not be of the "conforming" type, i.e. the type that moulds itself to the shape of the foot when worn, because the loading of the foot achieved by the supports would then be gradually reduced as the shape changed in response to the forces encountered during skiing. Further, supports that are quite flexible, yielding or resilient (e.g. air bladders or the like) are preferably not used because they permit the bones of the foot to move relative to each other and the heel to lift to an undesirable extent. The supports should be made of a firm, relatively unyielding material, e.g., a dense, plastic foam. The surface of such a support may of course be covered by a thin layer of a soft material, such as fabric, for comfort and absorbency.

The supports of the system can be custom fitted by forming and moulding them in place from a polymerizable foam, or other castable material, thus achieving proper conformity with the skier's shin and foot, and ensuring that all free space in the boot adjacent the areas of the foot or leg to be supported is occupied by the tongue.

The flexible connection between the supports used in a preferred form of the invention should allow full freedom at the ankle joint, without any tendency to bind against the lower parts of the leg bones and thus restrict their movement.

In the preferred form of the invention, as indicated above, the fitting and support system employs an upper and a lower support. The lower support can, however, be used alone, for example in sports shoes (e.g. a cycling shoe or a cross-country shoe) rather than boots.

Alternatively, and particularly for ski boots, the system may employ three supports, the third one being an additional upper support, known as a complementary support, that extends around the rear of the lower leg in the same region that the aforementioned upper support extends at the front of the leg. These two upper supports are preferably unconnected, or may be very loosely connected by thin, flexible webbing or the like with sufficient play being present to permit the relative motion of these two supports that is necessary during flexion of the ankle. Together, when the leg is in the upright position, the two upper supports completely encircle the leg in the region where it tapers inwardly above the ankle, and fill all of the voids within the boot that otherwise are present in this region. By eliminating voids in the boot in this way, greater control of movements is achieved, because the boot does not collapse inwardly into internal voids when bending of the ankle takes place, so resistance to bending provided by the boot does not change unpredictably.

During dorsiflexion of the foot, the upper part of a ski boot bears against the shin. For maximum comfort and control, this force should be evenly spread up and down the shin. Conventional tongues tend to concentrate all the pressure at the boot top producing a condition known as shin bite. The upper support of a preferred form of the present invention, however, distributes the pressure evenly because the support exactly follows the movements of the shin and bears evenly against all parts of it. Furthermore, since the upper support preferably does not taper in width towards the ankle joint, the pressure is distibuted over a larger area of the shin than with the conventional boot tongue. The shin is also often curved between the top and bottom of the upper support. If so, the upper support can be shaped to follow this curve on its innermost surface (e.g. by moulding in place) while having a symmetrical outer surface contacting the boot. This also helps to distribute the pressure evenly over the lower shin.

The support(s) forming the fit and support system can be separate from the footwear with which they are used, or can be permanently or removably attached thereto. For example, the supports can be bonded to the inside of a ski boot, boot liner, or the like. The footwear must be such that pressure can be applied to the supports and thus to the foot or leg. However, the way in which this is achieved is not important. For example, a boot or shoe may have a closure formed by toggle fasteners, laces or clamps. Alternatively, the pressure may be applied to the support(s) by a mechanism that is separate from the closure mechanism for the boot or shoe. For example, the support(s) may be drawn against the foot or leg by tensioned straps, cables or plates located within the boot or shoe and not connected to the closure device.

DESCRIPTION OF THE DRAWINGS

FIG. 9 is a cross-section similar to FIG. 2 but of a boot utilizing the tongue of FIG. 5;

FIG. 10 is a cross-section taken on line X—X of FIG. 7 (the wearer's leg not being shown);

FIG. 11 is a cross-section taken on line XI—XI of FIG. 7 (the wearer's leg not being shown);

FIGS. 12 and 13 are perspective views of alternative embodiments of the system of this invention;

FIG. 14 is a perspective view of a sole plate for use inside a ski boot in conjunction with the system of the invention.

DESCRIPTION OF THE PREFERRED EMBODIMENTS

Figure 2:
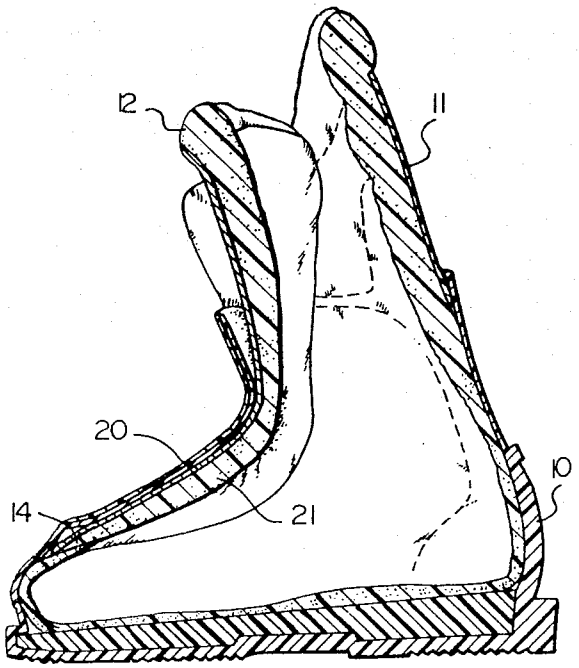
FIG. 2 (PRIOR ART)
FIG. 2 is a longitudinal vertical cross section of the boot of FIG. 1.

FIGS. 1 to 4 show a known ski boot. The boot consists of an outer boot 10, an inner boot 11 and a tongue 12. The boot also has an upper cuff attached to the outer boot 10, which fits around the outside of the outer and inner boots in the region of the ankle and is held together by toggle fasteners; however, the outer cuff has been omitted from the drawings so that the parts which provide support at the front of the ankle and foot can be seen more clearly. The outer cuff merely acts as a cover and also provides some lateral and medial support for the ankle. The outer boot 10 is made of a tough, slightly flexible, moulded plastic, whereas the inner boot 11 is made of a soft, flexible material of felt-like consistency that extends all around the foot except for the instep and the front of the ankle and shin. The instep and front of the ankle and shin are covered by the tongue 12, which may be attached to the inner boot 11 at its lowermost tip 14.

The inner boot 11 and the outer boot 10 are separate for ease of manufacture and so that the wearer may, for convenience, first put on the soft inner boot 11 and then put on the outer boot 10.

The outer boot 10 has overlapping flaps 15,16 over the instep, which are drawn together by toggles 18,19 or other fasteners, when the boot is worn.

Figure 3:
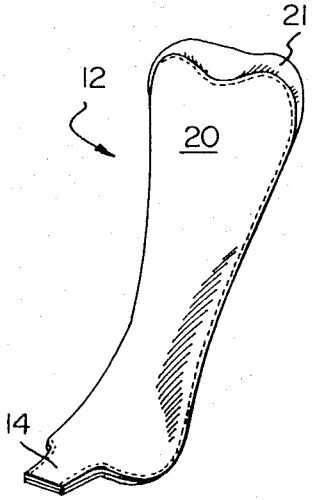
FIG. 3 (PRIOR ART)
FIG. 3 is a perspective view of a prior art tongue as used in the boot of FIGS. 1 and 2.

The tongue is shown in isolation in FIG. 3. The outer surface 20 is made of a rigid plastic sheet material and the inner surface 21 is made of cellular foam acting as a firm padding. The tongue has very little flexibility and is intended to provide rigid support for the instep and ankle joint.

Not only does the tongue 12, because of its stiffness, restrict dorsiflexion of the wearer's foot at the ankle joint, but forward bending of the ankle brings the wearer's shin (not shown) into contact with the upper part of the tongue 12. Continued forward movement of the shin can, because of the rigidity of the tongue, tend to make the tongue pivot forwardly at its lowermost point 14 rather than bend at its mid point adjacent the ankle. The outer boot 10, because of its relative flexibility over the instep, can permit such pivoting to take place to a small extent, so the lower part of the tongue is raised slightly from the wearer's instep and support for the bones of the foot is reduced, thus reducing the skier's control of the skis.

Another problem with the conventional tongue is that its relative thinness above the instep (see FIG. 4) can result in insufficient pressure being applied to the top of the foot. The tongue does not occupy all of the space between the top of the foot and the boot and the overlapping flaps 15,16 of the outer boot 10 tend to apply more pressure to the lateral sides of the tongue than to the instep, thus tending to crush the foot while giving it inadequate dorsal support.

Figure 6:
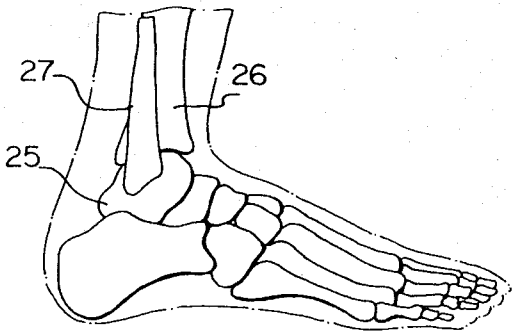
FIGS. 6, 7 and 8 are side views of a lower leg, ankle and foot showing the bone structure therein and, in the case of FIGS. 7 and 8, demonstrating the effects of the tongue of the present invention.

In order to provide improved support in a ski boot, the inventor studied the bone structure of the lower leg and foot. FIG. 6 provides a representation of these bones. The inventor views the foot as having, for these purposes, two distinct segments. The lower segment consists of the talus (astragalus) 25 and the bone structure below it, and the upper segment consists of the lower parts of the tibia 26 and fibula 27 which articulate with the talus 25 to form the ankle joint. The inventor has found that these two segments require quite different, and independent, support during skiing.

The lower segment of the foot consists of a large number of small bones joined by ligaments and muscles. The resulting natural flexibility is disadvantageous during skiing because the forces imposed on the foot exceed the resistance that can be provided by the ligaments and muscles, so the skier loses the ability to control the skis properly. According to the present invention, pressure is applied to these bones to reduce or prevent mutual movement, or to reinforce the existing ligament structure, so that the lower segment of the foot acts as a single unit.

The inventor also found that the tibia 26 and fibula 27 not only pivot at the ankle joint during plantarflexion and dorsiflexion of the foot, but also move forwardly as the bones slide over the upper surface of the talus 25. It was therefore realized that a mere pivoting or hinge-like arrangement at the ankle to allow such flexion would not be sufficient, because this would inevitably restrict proper movement unless the forward movement of the lower leg relative to the foot could also be accommodated.

Figure 5:
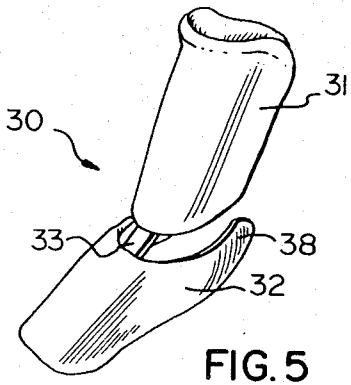
FIG. 5 is a perspective view of one embodiment of the tongue of the present invention.

To meet all of these various requirements, the preferred form of the present invention provides a ski boot fit and support system in at least two, and preferably three, separate parts. One embodiment of the two part system is shown in FIG. 5. The fit and support system is indicated generally by reference numeral 30. The system comprises an upper support 31 and a lower support 32. These two supports are separated slightly from each other and are loosely connected together by a flexible strip 33. The strip 33 maintains the system as a single unit, but allows the two supports 31,32 to move as if pivotally connected while also permitting forward movement of the upper support 31 relative to the lower support 32.

Figure 7:
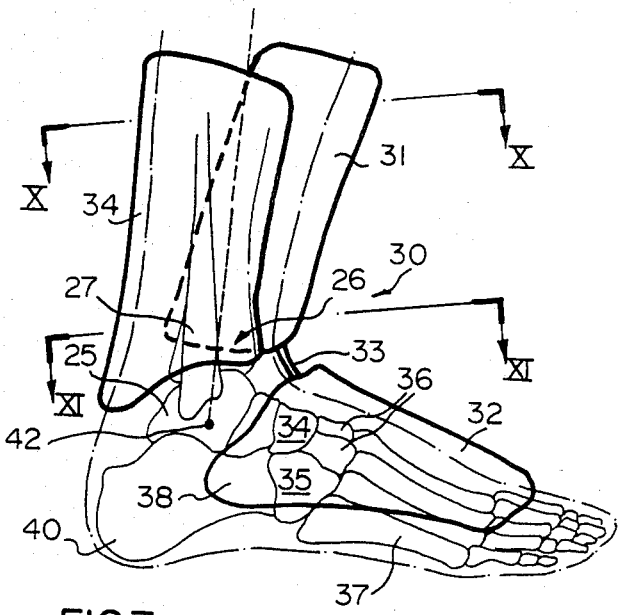
Figure 8:
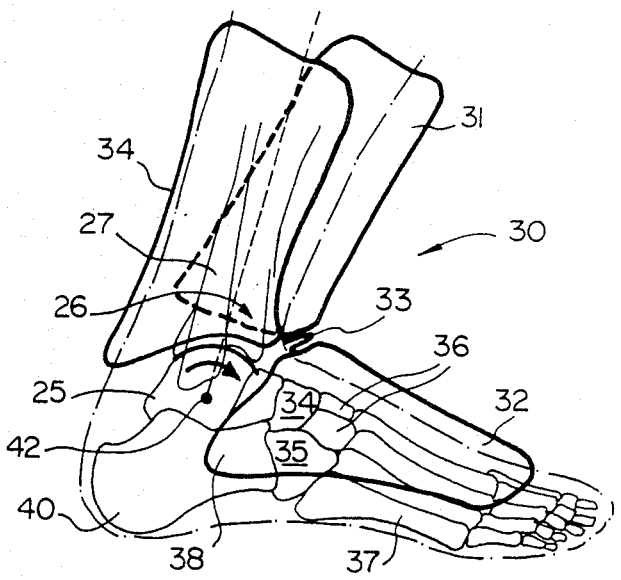

A three part system of the invention is shown in Figs. 7 and 8. In these drawings, a complementary support 34 is provided in addition to the two part system 30. This complementary support provides support for the sides and rear of the lower leg above the ankle and is not attached to the two part system. The complementary support does not in any way restrict flexion at the ankle joint because it is open at the front. The complementary support may be part of an inner boot similar to that referred to above in connection with the prior art boot.

FIG. 7 shows the leg in the upright position. The lower support 32 of the system extends over the instep of the foot in the region of the navicular, cuboid, cuneiform and metatarsal bones 34, 35, 36 and 37 respectively. Rearward extensions 38 on each side of the lower part 32 project at the sides of the foot adjacent the calcaneum or heel bone 40 below the ankle joint.

The lower support 32 of the system applies pressure to the bones which underlie it when inside a tightly fastened boot.

The resulting loading of these bones at right angles to the surface of the foot causes them to bear against each other quite firmly so that they move as a unit. The force is also transmitted to the heel bone to prevent it lifting from the bottom of the boot. Such loading acts like a band of pressure over the top and sides of the bones of the mid-foot, and does not merely crush the sides of the foot, leaving the dorsal (upper) surface unsupported, as do many prior art ski boots. The greater the loading of this type, the more stable the foot becomes during skiing. The lower support 32 of the system is therefore shaped to fit very snugly in the ski boot so that maximum pressure can be transmitted. Individual shaping to match the contours of the boot and the wearer's foot is preferred.

Despite this tight fitting over the instep, the ankle remains free to move because of the separation between the upper and lower supports 31 and 32 of the system. The interconnecting flexible strip 33 offers no resistance to the bending of the ankle joint, as can be seen from Fig. 8, which shows the leg in the forwardly pivoted position. The strip 33 merely bends upon itself to accommodate both the pivotal and the relative forward motion between the leg and the foot. The relative forward motion can be seen by comparing FIGS. 7 and 8. Numeral 42 indicates the pivot point of the ankle joint. The lower surface of the tibia 26 terminates a significant distance above this pivot point and slides over the upper surface of the talus 25 in the direction of the arrow in FIG. 8 as the foot is dorsiflexed. The flexibility of strip 33 allows for the resulting relative motion of the ankle that combines the pivotal and forward motions of the tibia 26 and fibula 27.

The flexible strip 33 can be omitted entirely, but it is extremely advantageous for the following reasons. Firstly, it tends to keep the two supports 31 and 32 of the system at the optimum spacing from each other when the ski boot is being put on and during normal wear. The two parts should be quite close to each other, but not so close that they bear against each other during dorsiflexion, since this would limit the free movement at the ankle joint. Secondly, the upper support 31 of the system may have a tendency to work upwardly out of the boot during normal wear, and the flexible strip 33 prevents this. Finally, the flexible strip 33 keeps the two supports of the system together when they are taken off so that the upper and lower supports for the right and left feet do not become mismatched when next used. A flexible strip may also be used to attach the complementary support 34 to the upper support 31 for the same reasons, if desired (although this is not shown in the drawings).

Figure 1:
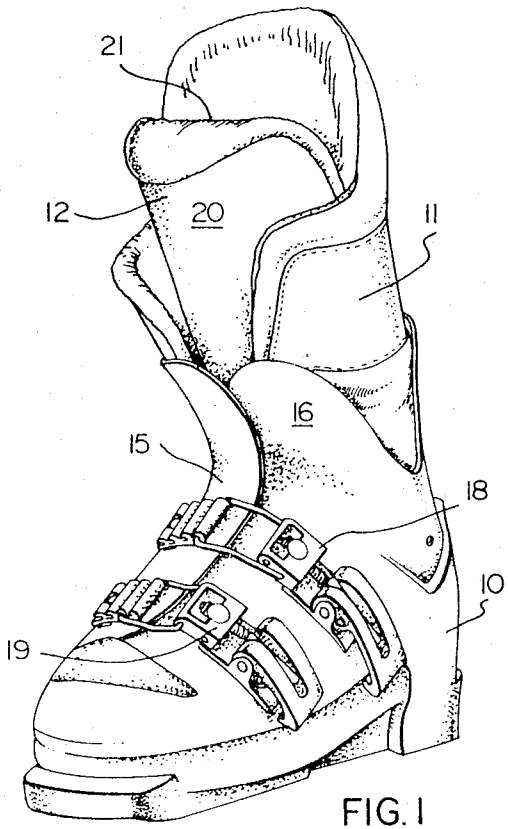
FIG. 1 (PRIOR ART)
FIG. 1 is a perspective view of a conventional ski boot showing the inner boot and prior art tongue.
Figure 4:
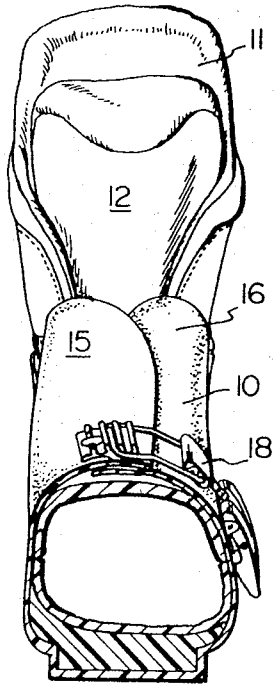
FIG. 4 (PRIOR ART)
FIG. 4 is a lateral, vertical cross section of the boot of FIG. 1 at approximately the position of the mid point of the foot between the toes and the ankle.

While the system presents no resistance to forward pivoting of the ankle joint, some resistance is provided by the outer boot, as shown in FIG. 9. The outer boot 10 and inner boot 11 used with the system of the present invention may be the same as those used in the prior art as shown in FIGS. 1, 2 and 4, so the same reference numerals are employed. The overlapping boot flaps 15 and 16 in the region of the ankle are capable of yielding gradually against force from the upper support 31 during dorsiflexion at the ankle joint. This takes place without affecting the pressure applied by the outer boot to the lower part 32 of the system because of the separation between the two supports 31 and 32 of the system and because the toggles 18 and 19 (see FIG. 1) prevent opening of the flaps at the top of the foot, but not at the ankle. This differs from the prior art system previously described in which pressure over the instep can be reduced during dorsiflexion and, if the tongue bends at the ankle joint, it bends rapidly and unpredictably after it has resisted dorsiflexion to a large extent. Such rapid and unpredictable bending of the prior art system can considerably upset the skier's balance, whereas a small amount of predictable resistance to dorsiflexion provided by the outer boot 10 in the arrangement of this invention is found to be dsirable by the skier. The yielding of the boot flaps 15 and 16 permitted by slight opening of the flaps accommodates the pivoting and forward motion of the tibia 26 and fibula 27 (see FIG. 8) without any binding or uneven resistance during the whole of the dorsiflexion motion.

The shape of the upper support 31 is also important. As can be seen from FIG. 3, the conventional tongue 12 tapers inwardly from the top so that the portion adjacent the ankle joint is quite narrow. The lower part of the leg also tapers in width in a similar fashion. However, ski boots usually do not taper inwardly to the same extent adjacent the ankle joint as can be seen from FIG. 1. Even though the boot can often be tightened to some extent around the lower leg, voids usually remain between the lower leg and the inner part of the boot, particularly just above the ankle bone. The inventor has found that it is disadvantageous to allow voids to remain in a region of the boot that is subject to stress because the boot material may fold inwardly unpredictably into the internal voids under stress, suddenly imparting more "give" to the boot and disturbing the skier's balance.

Figure 15:
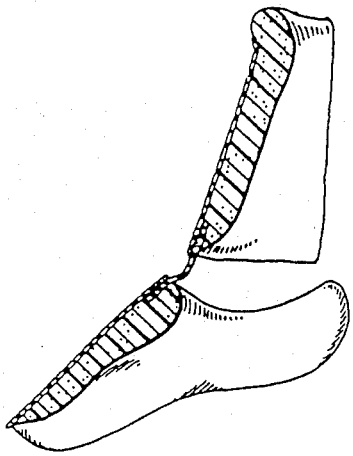
FIG. 15 shows a further embodiment of the system of the invention in which the upper support tapers slightly outwardly towards the bottom.

To avoid this, the upper support 31 according to a preferred form of the invention does not taper inwardly adjacent the ankle. The support is either of substantially constant width over its entire length (see FIGS. 5, 7–9, 12 and 13), or may taper outwardly towards the bottom see FIG. 15. The bottom part of the support wraps around the leg above the ankle as shown in dotted lines in FIGS. 7 and 8 and occupies the space between the leg and the boot above the ankle bone. The material of the outer boot 10 thus cannot collapse inwardly as the foot is dorsiflexed and thus cannot yield unpredictably under the forces encountered. Instead flaps 15, 16 (see FIG. 4) open progressively and provide constant and predictable resistance against the upper support 31. Since the upper support 31 is separate from the lower support 32 (except for the flexible strap 33) it fits securely against the lower leg throughout the ankle flexion movement and hence distributes the resistive force of the outer boot 10 evenly over a large area of the leg resulting in improved comfort and control for the skier.

The complementary support 34 overlaps the upper support 31 as shown in FIGS. 7 and 8. The overlapping portions should preferably be reduced in thickness to some extent as shown in FIGS. 10 and 11 to present a smooth contour both adjacent the leg and adjacent the inside surface of the boot.

FIGS. 10 and 11 (which represent the system for the right leg) also show that the upper support 31 may be thicker on the left side of the leg than on the right side. This is because the leg is not a regular oval shape in cross section and is more rounded on the right than on the left at the front. The situation is of course reversed for the left leg. The support thus occupies all of the space between the leg and the inside of the boot for a better fit when slightly asymmetric as shown.

FIGS. 12 and 13 show alternative embodiments of the system of this invention. The system shown in FIG. 12 is similar to that in FIG. 5 but the flexible strip 33 is releasably attached to the two supports 31 and 32. This is achieved by providing a hook and loop fastener 45 (e.g. as sold under the VELCRO Trademark) or a similar fastener between the strip and the support at at least one end of the strip 33. This enables the upper and lower supports 31,32 to be quickly separated so that the wearer can match the best fitting lower support 31 to the best fitting upper support 32 from a stock of different sizes. The fastener also allows the wearer to change the separation between the two supports 31 and 32 to provide optimum fit and freedom of movement. However, the fastener 45 holds the supports together securely during use and subsequent storage.

The embodiment of FIG. 13 functions in the same way as the systems of FIGS. 5 and 12, but the two supports 31 and 32 are joined by a very thin layer 46 of material that extends laterally at the joint more widely than the strip 33 of the previous embodiments (the strip 33 may, for example, be about one inch wide). The layer 46 may be made of the same material as the coverings at the front of the top support 31 and the top of the lower support 32, but it must be thin enough and must space the top and lower supports from each other sufficiently to provide the desired flexibility and freedom of motion at the joint. Reinforcing strips 48 may be provided to prevent tearing of the thin layer 46 when the boot is being put on or taken off by the skier. The reinforcing strips should themselves be flexible enough not to interfere with the dorsiflexion.

FIG. 14 shows a sole plate 50 preferably used with the fit and support system of the present invention. The sole plate 50 may be moulded integrally inside the outer boot 10 (see FIG. 9) or may be a separate unit that slides into position inside the outer boot. The upper surface 51 of the sole plate is contoured to fit the plantar surface of the skier's foot and, in particular, provides an arch support 52. The contours should preferably be custom moulded from a rigid material in the shape of the skiers foot to provide optimum fit and support. The use of such a sole plate, rather than a sole plate with a substantially flat upper surface (e.g. as shown in FIG. 2), helps to lock the bones of the lower foot together so that they act as a single unit, and helps to prevent lifting of the heel bone relative to the sole plate. Thus the bones are loaded from above by the lower support 32 and bear firmly against the contoured upper surface 51 of the sole plate, giving the foot exceptional stability and the skier exceptional control.

The two supports 31 and 32 of the tongue may be made from any suitable material, but preferably they have a tough outer layer 55 (see FIG. 12) of dense plastic or other material capable of providing good durability and firm support, and a fairly thick inner layer 56 of quite rigid cellular plastic (e.g. a plastic foam material sold under the trademark TUFF-CELL) that is comfortable but provides proper support and loading of the bones of the lower foot. The flexible strip 33 may be made of leather, webbing, plastic or any other suitable material.

Both the lower support 32 and the upper support 31 should preferably be made (either by moulding in place or by suitable shaping of a pre-formed unit, which may be made of thin layers of foam material adhered together) to occupy the whole of the space between the regions of the foot that are to be contacted and the adjacent parts of the outer boot 10. When the flaps of the outer boot are drawn together for closure there are then no voids that could permit distortion of the outer boot and thus improper loading of the foot and leg.

Although a preferred embodiment of the invention has been described above, many other embodiments are possible within the limits of the appendant claims. For example, the lower support 32 can be used independently of the other supports, particularly for use in shoes (e.g. cycling shoes) where immobilization of the lower foot is required. Such shoes do not extend above the ankle so upper supports are not needed and could not be used.

In the case of boots, the preferred embodiment described above employs supports that are separate from the boot structure. However, the supports may be bonded to the inner surface of the boot, or boot liner, to form a permanent part thereof.

I claim:

1. A fit and support system for sports footwear, comprising: a lower support shaped and dimensioned to fit within the footwear and to bear evenly against the dorsal surface of the foot, including the medial and lateral aspects thereof, forwardly and clear of the ankle joint but covering a majority of the mid-foot bones, and to occupy substantially all free space between said dorsal surface and an adjacent inner surface of the footwear; and an upper support shaped and dimensioned to bear evenly against the lower leg at the front above and clear of the ankle joint; said supports being capable of independent relative motion to permit completely unrestricted dorsiflexion of the foot at the ankle joint within the normal range; and said lower support being sufficiently firm and unyielding to transmit pressure constantly during use from said adjacent inner surface of the footwear to the wearer's foot in order to substantially reduce articulation of said mid-foot bones and to substantially eliminate upward movement of said bones relative to the footwear.

2. A system according to claim 1 wherein the upper and lower supports are loosely attached together by a flexible connector.

3. A system according to claim 2 wherein the flexible connector is a strip of material selected from leather, webbing and plastic.

4. A system according to claim 2 wherein the flexible connector is detachable from at least one of the lower and upper supports.

5. A system according to claim 4 wherein the connector is detachable by virtue of a hook and loop fastener between the flexible connector and said at least one support.

6. A system according to claim 2 wherein the flexible connector is a strip of flexible material.

7. A system according to claim 1 wherein the lower support is shaped to extend over the forward part of the talus, the navicular, cuneiform and cuboid bones, and the metatarsals.

8. A system according to claim 7 wherein the lower support also extends over the forward parts of the lateral and medial surfaces of the calcaneum.

9. A system according to claim 1 wherein the lower support is made at least partially from a dense unyielding polymer foam material.

10. A system according to claim 9 wherein the foam material was formed and moulded in place around the wearer's foot within the footwear.

11. A system according to claim 9 wherein the lower support has an outer layer of tough polymeric material.

12. A system according to claim 1 wherein the upper support is made at least partially from a dense unyielding polymer foam material.

13. A system according to claim 12 wherein the foam material was formed and moulded in place around the wearer's shin within the boot.

14. A system according to claim 12 wherein the upper support has an outer layer of tough polymeric material.

15. A system according to claim 1 wherein the lower support is so dimensioned that it does not cover the toes.

16. A system according to claim 1 wherein the supports occupy substantially all of the space between the surfaces of the leg and foot contacted by the supports and the adjacent surfaces of the footwear.

17. A system according to claim 1 comprising a complementary support shaped and dimensioned to extend around the rear and sides of the lower leg above the ankle and to overlap said upper support at the sides of the leg.

18. A system according to claim 1, claim 17 or claim 18 wherein the upper support increases in width from its upper part most distant from the ankle joint to its lower part adjacent the ankle.

19. A system according to claim 17 wherein the upper support and the complementary support have thinner material at the overlapping parts than elsewhere so that the total thickness of the overlapping parts does not differ substantially from the individual thicknesses of the supports in non-overlapping parts.

20. A system according to claim 1, claim 17 or claim 18 wherein the upper support has substantially the same width over the entire vertical length of the support.

21. A support for sports footwear comprising a body of material shaped and dimensioned to fit within the footwear and to bear evenly against the dorsal surface of the foot, including the medial and lateral aspects thereof, forwardly and clear of the ankle joint so as not to restrict dorsiflexion of the foot at the ankle joint within the normal range while covering a majority of the mid-foot bones, and to occupy substantially all free space between said dorsal surface and an adjacent inner surface of the footwear, the material being sufficiently firm and unyielding to transmit pressure constantly during use from said adjacent inner surface of the footwear to the wearer's foot in order to substantially reduce articulation of said mid-foot bones and to substantially eliminate upward movement of said bones relative to the footwear.

22. A boot assembly for a foot, comprising an outer boot of stiff material having a fastener therefor, and a fit and support system for the boot, said system comprising: a lower support shaped and dimensioned to fit within the footwear and to bear against the dorsal surface of the foot, including the lateral and medial aspects thereof, forwardly and clear of the ankle joint but covering a majority of the mid-foot bones, and to occupy substantially all free space between said dorsal surface and an adjacent inner surface of the outer boot; and an upper support shaped and dimensioned to bear against the lower shin at the front above and clear of the ankle joint; said supports being capable of independent relative motion to permit completely unrestricted dorsiflexion of the foot at the ankle joint within the normal range; and said lower support being sufficiently firm and unyielding in order to transmit pressure constantly during use from said adjacent inner surface of the boot to the wearer's foot in order to substantially reduce articulation of said mid-foot bones and to substantially eliminate upward movement of said bones relative to the boot.

23. An assembly according to claim 22 also including an inner boot of soft material.

24. An assembly according to claim 22 including an inflexible sole plate within the boot for supporting the wearer's foot, said sole plate having an upper surface shaped to correspond to the contours of the plantar surface of the foot.

25. An assembly according to claim 22, 23 or 24, further comprising a complementary support separate from the other supports, the complementary support being positioned and dimensioned to support the sides and rear of the lower leg above the ankle.

26. Sports footwear including a support for the foot, said support comprising a body of material shaped and dimensioned to fit within the footwear and to bear evenly against the dorsal surface of the foot, including the medial and lateral aspects thereof, forwardly and clear of the ankle joint so as not to restrict dorsiflexion of the foot at the ankle joint within the normal range, while covering a majority of the mid-foot bones, and to occupy substantially all free space between said dorsal surface and an adjacent inner surface of the footwear, said material being sufficiently firm and unyielding to transmit pressure constantly during use from said adjacent inner surface of the footwear to the wearer's foot to substantially reduce articulation said mid-foot bones and to substantially eliminate upward movement of said bones relative to the footwear.

* * * * *